United States Patent [19]

Matsumoto et al.

[11] 4,368,369

[45] Jan. 11, 1983

[54] ELECTRICAL SWITCH

[75] Inventors: Masataka Matsumoto; Kouichi Nakajima, both of Tanashi, Japan

[73] Assignee: Citizen Watch Co., Ltd., Tokyo, Japan

[21] Appl. No.: 240,794

[22] Filed: Mar. 5, 1981

[30] Foreign Application Priority Data

| | | | |
|---|---|---|---|
| Mar. 14, 1980 | [JP] | Japan | 55-32404 |
| Mar. 25, 1980 | [JP] | Japan | 55-37847 |
| Apr. 8, 1980 | [JP] | Japan | 55-45236 |
| Apr. 15, 1980 | [JP] | Japan | 55-49793 |

[51] Int. Cl.[3] ..... H01H 13/70; H01H 1/02

[52] U.S. Cl. ..... 200/264; 200/5 A; 200/159 B; 200/292; 339/DIG. 3

[58] Field of Search ..... 200/264, 292, 159 B, 200/5 A; 339/DIG. 3

[56] References Cited

U.S. PATENT DOCUMENTS

| | | | |
|---|---|---|---|
| 3,789,167 | 1/1974 | Seeger | 200/292 |
| 3,959,610 | 5/1976 | Finnegan et al. | 200/264 |
| 3,983,355 | 9/1976 | Hyodo | 200/264 |
| 4,158,115 | 6/1979 | Parkinson et al. | 200/292 |
| 4,180,711 | 12/1979 | Hirata et al. | 200/292 |
| 4,259,551 | 3/1981 | Ohtani et al. | 200/302 |
| 4,308,439 | 12/1981 | Itoh | 200/159 B |

*Primary Examiner*—John W. Shepperd

*Attorney, Agent, or Firm*—Birch, Stewart, Kolasch & Birch

[57] ABSTRACT

A pushbutton switch has a plurality of pushbuttons and corresponding switch contacts. The switch contacts are formed conductive patterns printed on an insulation plate or sheet and are in contact with a pressure conductive rubber sheet. The pressure conductive rubber sheet includes conductive powder and is rendered conductive when compressed by the pushbutton, so that the corresponding switch contacts are closed by the conductive rubber sheet. A plurality of pairs of switch contacts are connected to terminals which are arranged in an adjacent relation.

5 Claims, 21 Drawing Figures

ELECTRICAL SWITCH

BACKGROUND OF THE INVENTION

The present invention relates to an electrical switch and more particularly to a multiple-pushbutton switch for electronic timepieces.

A known multiple-pushbutton switch comprises a diagragm having a plurality of flexible convex portions, a movable contact provided on an underside of each flexible convex portion and a pair of fixed contacts corresponding to each movable contact. The flexible convex portion is deflected by a pushbutton to thereby bring the movable contact into electrical contact with the corresponding fixed contacts, so that the fixed contacts are electrically connected each other. In such a switch, the flexible convex portion is liable to be broken by repeated deflection with the pushbutton.

SUMMARY OF THE INVENTION

An object of the present invention is to eliminate the above described disadvantage of the conventional multiple-pushbutton switch.

Another object of the present invention is to provide a multiple-pushbutton switch which manifests a long life by having fewer moving parts and which may be formed in a small size.

According to the present invention there is provided an electrical switch comprising a base made of insulation, a pressure conductive rubber sheet which is rendered conductive by compression thereof, said pressure conductive rubber sheet being disposed on said base, printed conductive patterns provided adjacent said pressure conductive rubber sheet for forming a plurality of pairs of switch contacts, terminals connected to said switch contacts, said terminals being arranged in an adjacent relation, conductive connecting means provided in said base for connecting said terminals to an electric device to be provided adjacent then back side of said base, means for compressing said pressure conductive rubber sheet at portions corresponding to said a plurality of pairs of switch contacts, and a cover secured to said base for receiving said pressure conductive rubber sheet.

Other objects and features of the present invention will become more apparent from the following description with reference to the accompanying drawings.

Figure 1:
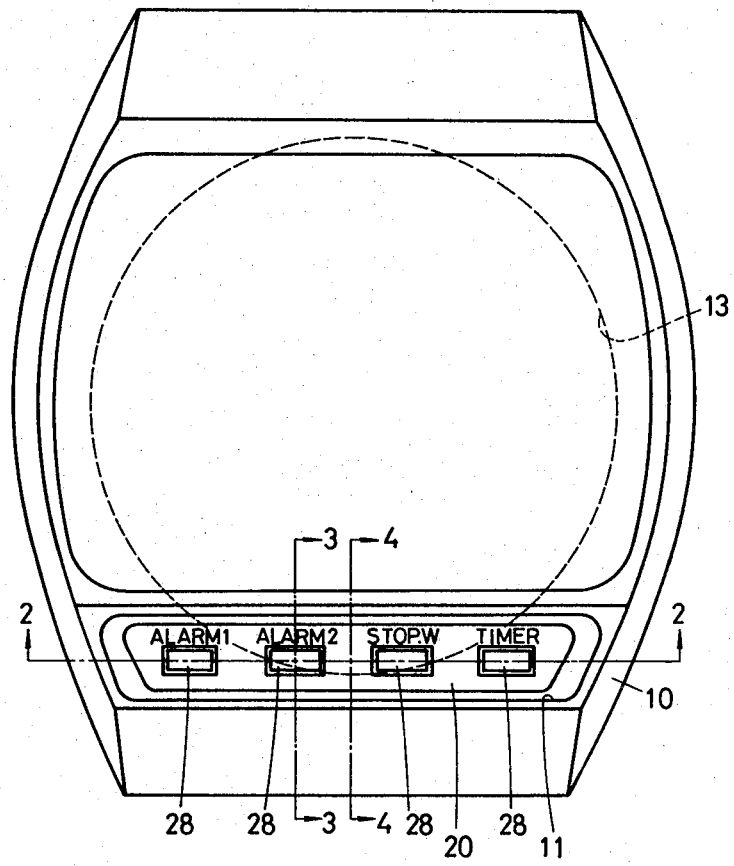
FIG. 1 is a plan view showing an electronic timepiece in which a multiple-pushbutton switch according to the present invention is provided.

DESCRIPTION OF THE PREFERRED EMBODIMENTS:

Referring to FIGS. 1 to 4, a watch case 10 has a recess 11 at one side in an upper portion for receiving a multiple-pushbutton switch unit 20. A rectangular perforation 12 is provided at a central portion of the recess 11 so as to communicate with a space 13 for a module 30 of an electronic device of the watch. The switch unit 20 comprises a base 21, a pressure conductive rubber sheet 22 on the base 21, an upper sheet 23 on the sheet 22, and a cover 24. The base 21, upper sheet 23 and cover 24 are made of plastics. The pressure conductive rubber sheet 22 comprises rubber with electrically conductive powder included therein. The rubber sheet is rendered electrically conductive when compressed by pressure. The base 21 comprises a plate portion 21*a* and a leg portion 21*b* engaged with the perforation 12. The plate portion 21*a* has a groove 21*c* for an O-ring 25 around the perforation 12 and a recess 21*d* in the surface thereof. The leg portion 21*b* has a peripheral projection 21*e* and a hole 21*f* for receiving an electrically conductive connecting rubber 27.

Figure 5:
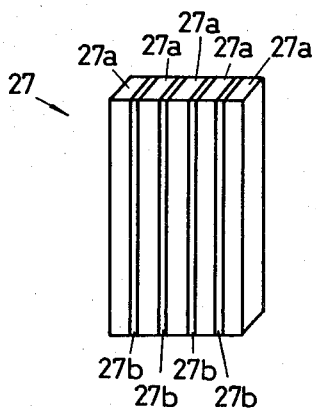
FIG. 5 is a perspective view of a conductive connecting rubber.
Figure 6:
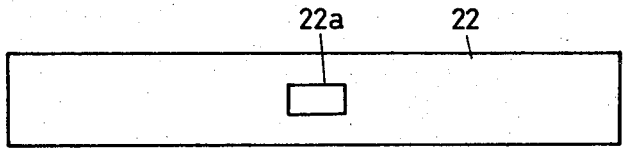
FIG. 6 is a plan view of a sheet of pressure conductive rubber.

The conductive connecting rubber 27 includes electrically conductive powder therein and comprises a plurality of conductive members 27*a* separated by electrical insulation members 27*b* as shown in FIG. 5. The pressure conductive rubber sheet 22 has a perforation 22*a* which corresponds to the hole 21*f* of the leg portion 21*b*.

Figure 7:
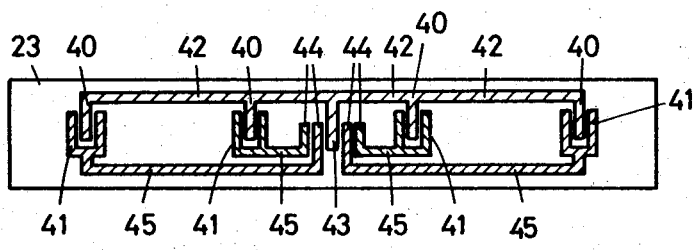
FIG. 7 is a plan view showing the underside of an upper sheet on which patterns are printed.

Referring to FIG. 7, the upper sheet 23 has a conductive pattern printed on the underside thereof. The conductive pattern comprises common conductive patterns 40 and individual conductive patterns 41. Each common conductive pattern 40 and bifurcate individual conductive pattern 41 form a pair of switch contacts. Common conductive patterns are connected to a terminal portion 43 by connecting portions 42 and each individual conductive pattern 41 is connected to a terminal portion 44 by a connecting portion 45. The terminal portion 43 for common conductive patterns is located in a central portion of the upper sheet 23 and other terminal portions 44 for individual conductive patterns are located opposite sides of the terminal portion 43 so as to be engaged with conductive members 27*a* of the conductive connecting rubber 27 respectively, as hereinafter described.

The cover 24 has a recess 24*a* in the underside for receiving the base 21 and the upper sheet 23 and openings 24*b* corresponding to switch contacts. A recess 24*c* is provided around the opening 24*b* for receiving a flange 28*a* of a pushbutton 28.

Now describing the method for assembling the switch, the pressure conductive rubber sheet 22 is engaged in the recess 21*d* of the base 21 and the upper sheet 23 is put on the pressure conductive rubber sheet 22 engaging the conductive pattern thereof with the sheet 22. The peripheral portion of the upper sheet 23 is secured to the base by suitable means such as the ultrasonic welding for a watertight seal. Each pushbutton 28 is engaged with the opening 24*b* and the base 21 is engaged with the cover and secured thereto by adhesive. Further an indication plate 29 is attached to the cover 24 by adhesive. The conductive connecting rubber 27 is inserted into the space 21*f* of the base 21 so that each of terminals 43 and 44 are connected to the corresponding conductive member 27*a*. The O-ring 25 is engaged with the groove 21*c*, thus the multiple-pushbutton switch unit 20 is formed. The switch unit 20 is engaged with the recess 11 of the watch case 10 by inserting the leg portion 21*b* of the base 21 into the perforation 12. An E-shaped snap ring 26 is inserted between the projection 21*e* and watch case. Thus, the switch unit 20 is secured to the watch case 10. In the assembled condition, each conductive member 27*a* is connected to a terminal (not shown) provided on the module 30.

When each of pushbuttons 28 is depressed, the upper sheet 23 is pressed against the pressure conductive rubber sheet 22. Accordingly, a part of the rubber sheet 22 covering the switch contacts formed by conductive patterns 40 and 41 is compressed. The compressed part of the rubber sheet 22 is rendered conductive, so that the contacts are connected each other through the pressure conductive rubber sheet 22, and hence the circuit including terminals 43 and 44 is closed.

In accordance with the present invention, switch contacts are connected by compressing the pressure conductive rubber sheet. Thus, there is little deflection ocurring in the switch unit, which means an increase of durability of the rubber sheet. Further, switch contacts of the multiple-pushbutton switch are connected to conductive connecting members 27*a* which are aggregated in a central portion. Thus, the terminal area to be provided on the switch unit and the module of the electronic timepiece may be reduced. Thus, the present invention provides a multiple-pushbutton switch which may be made in a small size and has a long life.

Figure 8:
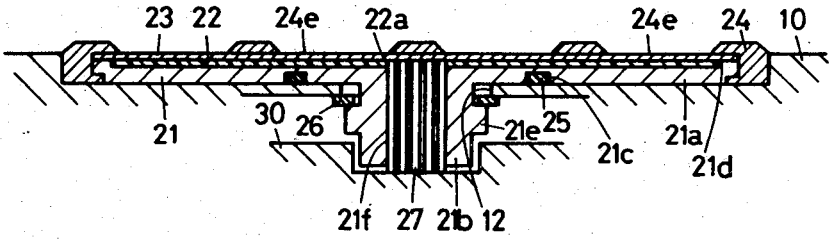
FIG. 8 is a sectional view showing a second embodiment of the present invention.

Referring to FIG. 8 showing a second embodiment of the present invention, the switch unit is not provided with pushbuttons. The upper sheet 23 is exposed to the outside through openings 24*e* of the cover 24. By pushing the exposed portion of the upper sheet 23 with suitable means, the corresponding switch contacts are closed in the same manner as the first embodiment.

Figure 9:
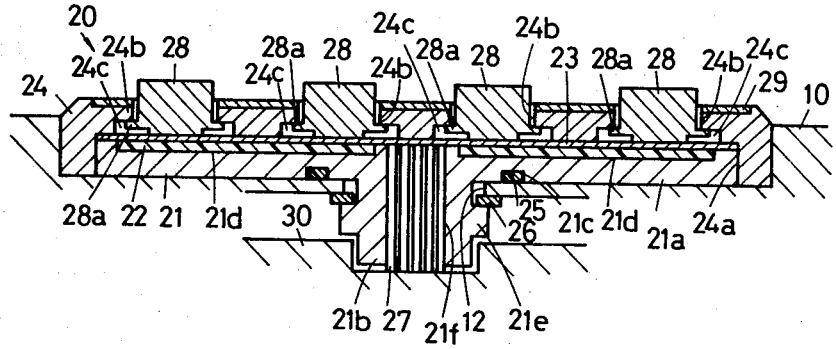
FIG. 9 is a sectional view showing a third embodiment of the present invention.
Figure 10:
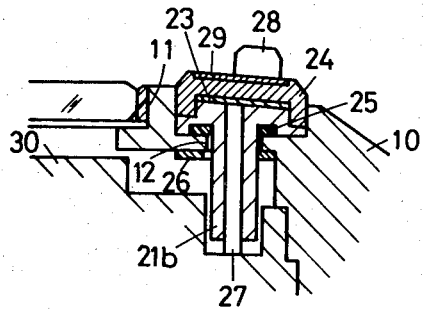
FIG. 10 is a cross sectional view of the switch of FIG. 9.

Referring to FIGS. 9 and 10 showing a third embodiment of the present invention, the base 21 has a pair of recesses 21*d*. Accordingly, the pressure conductive rubber sheet 22 is divided into two members which are engaged with recesses 21*d* respectively. Other structure is the same as the first embodiment and the same parts thereof are identified with the same reference numerals as FIGS. 2 and 4.

Figure 11:
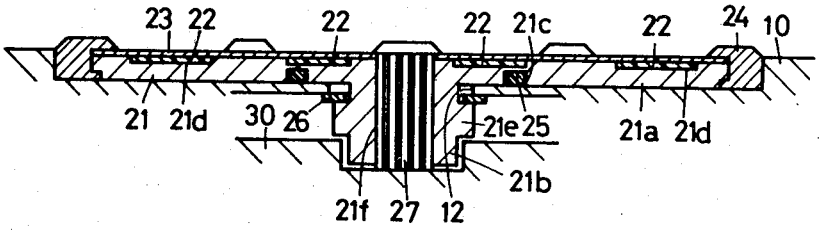
FIG. 11 is a sectional view of a fourth embodiment of the present invention.
Figure 12:
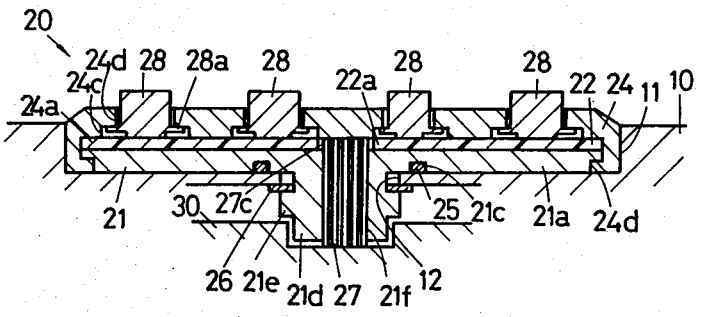
FIG. 12 is a sectional view of a fifth embodiment of the present invention.
Figure 13:
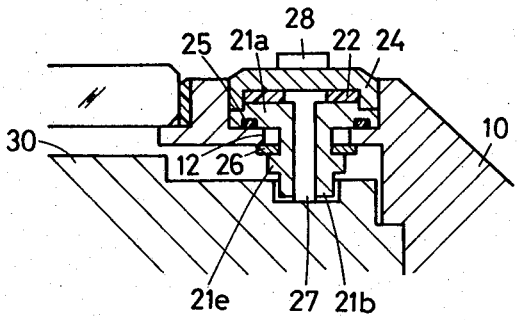
FIG. 13 is a cross sectional view of the switch of FIG. 12.

FIG. 11 shows a fourth embodiment of the present invention. The switch is similar to the switch shown in FIG. 8. The base 21 has four recesses 21*d*. The pressure conductive rubber sheet 22 is divided into four members which engage with recesses 21*d* respectively. In accordance with the third and fourth embodiments, the switch may be economically made with the small amount of pressure conductive rubber sheet.

Figure 14:
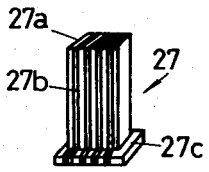
FIG. 14 is a perspective view of a conductive connecting rubber used in the switch.
Figure 15:
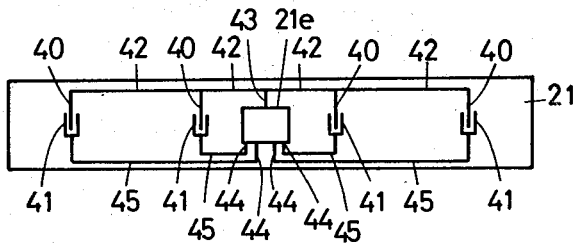
FIG. 15 is a plan view of a base.
Figure 16:
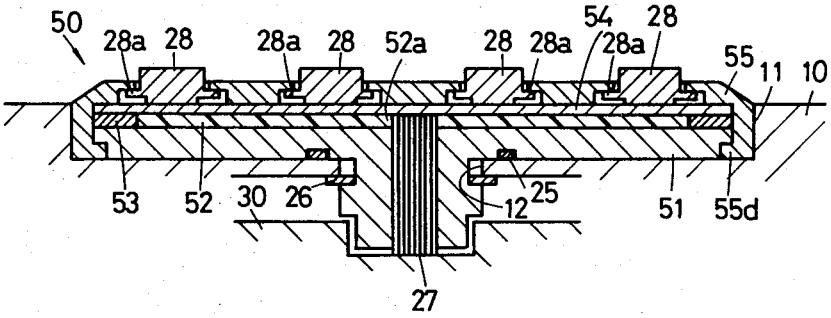
FIG. 16 is a sectional view of a sixth embodiment of the present invention.
Figure 17:
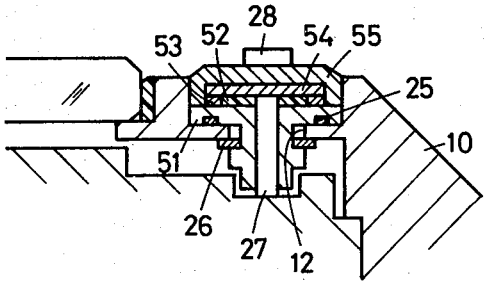
FIG. 17 is a cross sectional view of the switch of FIG. 16.

Referring to FIGS. 12 to 15, the switch unit of this embodiment is formed without the upper sheet 23 included in previous embodiments. As shown in FIG. 15, the conductive pattern comprising common conductive patterns 40 and individual conductive patterns 41 are printed on the base 21. Terminals 43 and 44 are arranged on opposite sides of the hole 21*f* of the base 21. On the other hand, the conductive connecting rubber 27 has a flange 27*c* at the top thereof as shown in FIG. 14. The pressure conductive rubber sheet 22 has a perforation 22*a* for receiving the flange 27*c* of the conductive connecting rubber 27.

To assemble the switch unit, the pressure conductive rubber sheet 22 and the base 21 are engaged with the recess 24*a* of the cover 24 which is made of metal. Projections 24*d* of the cover 24 are bent to secure the sheet 22 and the base 21 to the cover, so that terminals 43 and 44 are pressed against conductive members 27*a* of the flange 27*c*. Thus, conductive patterns on the base 21 are connected to conductive connecting member 27.

When the pushbutton 28 is depressed, a corresponding part of the pressure conductive rubber sheet 22 is compressed. Thus, switch contacts on the base are connected by the conductive rubber sheet 22.

It is also possible to compress directly the pressure conductive rubber sheet of the embodiment of FIGS. 12–15 through an opening shown with respect as to the second embodiment shown in FIG. 8.

Referring to FIGS. 16 to 21 showing a sixth embodiment of the present invention, a switch unit 50 comprises a base 51, a pressure conductive rubber sheet 52 on the base 51, an electrically conductive rubber frame 53 around the sheet 52, an upper sheet 54 on the sheet 52 and frame 53, and a cover 55. The base 51 and upper sheets 54 are made of plastics and the cover 55 is made of metal.

Figure 18:
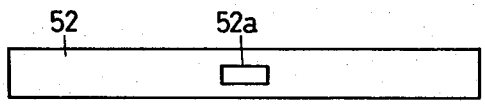
FIG. 18 is a plan view of a pressure conductive rubber sheet.
Figure 19:
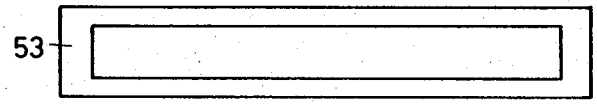
FIG. 19 is a plan view showing an electrically conductive rubber frame.

The pressure conductive rubber sheet 52 has a perforation 52*a* as shown in FIG. 18. The conductive rubber frame 53 is adapted to engage with the pressure conductive rubber sheet 52 as shown in FIG. 19.

Figure 20:
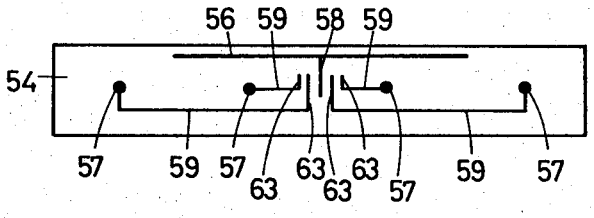
FIG. 20 is a plan view of an upper sheet.

Referring to FIG. 20, the upper sheet 54 has a conductive pattern printed on the underside thereof. The conductive pattern comprises a common conductive pattern 56 and individual contacts 57. The common conductive pattern 56 is connected to a terminal portion 58 and each individual contact 57 is connected to a terminal portion 63 by a connecting portion 59.

Figure 21:
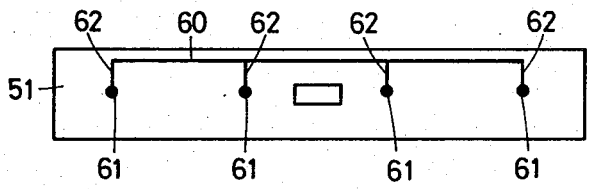
FIG. 21 is a plan view of a base.

On the other hand, another conductive pattern is printed on the base 51. As shown in FIG. 21, the conductive pattern comprises a common conductive pattern 60, contacts 61 corresponding to contacts 57 and connecting portion 62 connecting the contacts 61 to the common conductive pattern 60. The common conductive pattern 60 is electrically connected to the common conductive pattern 56 through the conductive rubber frame 53.

Figure 2:
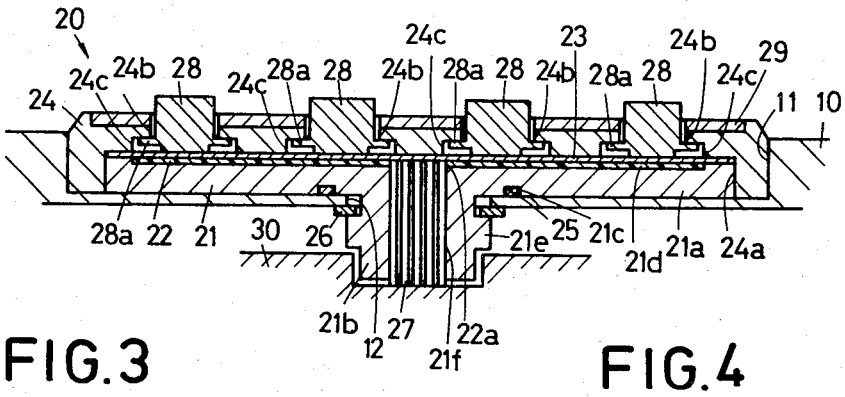
FIG. 2 is a sectional view taken on the line 2—2 of FIG. 1.
Figure 3:
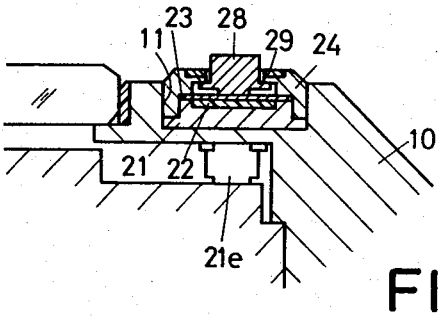
FIG. 3 is a sectional view taken on the line 3—3 of FIG. 1.
Figure 4:
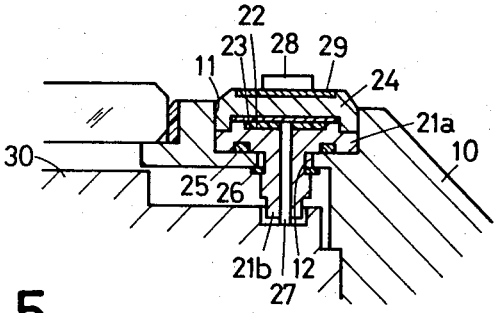
FIG. 4 is a sectional view taken on the line 4—4 of FIG. 1.

Other parts of the switch are the same as the switch unit of FIG. 2 and are identified by same numerals as the figure. The switch unit is assembled by bending projections 55*d* of the cover 55.

When one of pushbuttons 28 is depressed the upper sheet 54 is pressed against the pressure conductive rubber sheet 52. Accordingly, a corresponding part of the rubber sheet 52 is compressed. Thus, corresponding contacts 57 and 61 are electrically connected to each other through the compressed portion of the pressure conductive rubber 52. Accordingly, the circuit connecting the conductive rubber member 27*a*, terminal 58, conductive pattern 56, contacts 61 and 57, and terminal 63 is closed.

Although the switch unit in above described embodiments is provided in the upper portion of the watch case, it may be provided in a side portion or a back portion of the watch case.

What is claimed is:

1. An electrical switch comprising a base made of insulating material, a pressure conductive rubber sheet which is normally non-conductive and rendered conductive by compression thereof, said pressure conductive rubber sheet being disposed on said base, an upper sheet of insulating material adjacent said pressure conductive rubber sheet, printed conductive patterns on the lower surface of said upper sheet and in contact with said pressure conductive rubber sheet for forming a plurality of pairs of switch contacts, said conductive patterns comprising terminal portions connected to said switch contacts, said terminal portions being arranged adjacent each other in a central portion of said upper sheet, conductive connecting means provided in said base for connecting said terminal portions to an electric device positioned on an opposide side of said pressure conductive rubber sheet from said upper sheet, said conductive connecting means comprising a plurality of conductive connecting rubbers separated from each other by insulation means, said conductive rubbers being in abutting contact with respective terminal portions and with the electric device, means for applying pressure to said upper sheet for compressing said pressure conductive rubber sheet at portions corresponding to said plurality of pairs of switch contacts, and a cover secured to said base for receiving said upper sheet and said pressure conductive rubber sheet.

2. An electrical switch according to claim 1 wherein said means for applying pressure to said upper sheet for compressing said pressure conductive rubber sheet comprises pushbuttons provided in said cover.

3. An electrical switch according to claim 1 wherein said means for applying pressure to said upper sheet for compressing said pressure conductive rubber sheet comprises openings formed in said cover for exposing said upper sheet.

4. An electrical switch according to claim 1 comprising a plurality of said pressure conductive rubber sheets.

5. An electrical switch comprising a base made of insulating material, a pressure conductive rubber sheet which is normally non-conductive and rendered conductive by compression thereof, said pressure conductive rubber sheet being disposed on said base, an upper sheet of insulating material adjacent said pressure conductive rubber sheet, printed conductive patterns on the lower surface of said upper sheet and in contact with said pressure conductive rubber sheet for forming a plurality of switch contacts, printed conductive patterns and terminal portions on said base so as to provide a plurality of pairs of switch contacts on opposite sides of said pressure conductive rubber sheet, said conductive patterns comprising terminal portions connected to said switch contacts, said terminal portions being arranged adjacent each other in a central portion of said upper sheet, conductive connecting means provided in said base for connecting said terminal portions to an electric device positioned on an opposite side of said pressure conductive rubber sheet from said upper sheet, said conductive connecting means comprising a plurality of conductive connecting rubbers separated from each other by insulation means, said conductive rubbers being in abutting contact with respective terminal portions and with the electric device, means for applying pressure to said upper sheet for compressing said pressure conductive rubber sheet at portions corresponding to said plurality of pairs of switch contacts, and a cover secured to said base for receiving said upper sheet and said pressure conductive rubber sheet.

* * * * *